US012398965B2

(12) United States Patent
Christiansen et al.

(10) Patent No.: US 12,398,965 B2
(45) Date of Patent: Aug. 26, 2025

(54) CLEANING SYSTEM, A PLATE HEAT EXCHANGER AND A METHOD FOR CLEANING THE PLATE CHANNELS IN A PLATE HEAT EXCHANGER

(71) Applicant: FoulingCure ApS, Jordrup (DK)

(72) Inventors: Carsten Kjær Christiansen, Vorbasse (DK); Steen Petersen, Børkop (DK)

(73) Assignee: FoulingCure ApS, Jordrup (DK)

( * ) Notice: Subject to any disclaimer, the term of this patent is extended or adjusted under 35 U.S.C. 154(b) by 337 days.

(21) Appl. No.: 17/916,429

(22) PCT Filed: Apr. 27, 2020

(86) PCT No.: PCT/DK2020/050115
§ 371 (c)(1),
(2) Date: Sep. 30, 2022

(87) PCT Pub. No.: WO2021/219174
PCT Pub. Date: Nov. 4, 2021

(65) Prior Publication Data
US 2023/0194197 A1 Jun. 22, 2023

(51) Int. Cl.
*F28G 9/00* (2006.01)
*F28G 15/04* (2006.01)

(52) U.S. Cl.
CPC ..... *F28G 15/04* (2013.01); *F28G 9/00* (2013.01)

(58) Field of Classification Search
None
See application file for complete search history.

(56) References Cited

FOREIGN PATENT DOCUMENTS

CN 108759553 A 11/2018
KR 101402686 B1 6/2014
(Continued)

OTHER PUBLICATIONS

WO 2013/085332A1 machine translation, Multistage Washing Apparatus for a Plate-Type Heat Exchanger, Hong (Year: 2013).*
(Continued)

*Primary Examiner* — Cristi J Tate-Sims
(74) *Attorney, Agent, or Firm* — BLANK ROME LLP

(57) ABSTRACT

Disclosed is a cleaning system (1) for cleaning the plate channels (2) in a plate heat exchanger (3) during normal use of the heat exchanger (3), wherein the heat exchanger (3) comprises an inflow channel (4) through which a fluid enters the heat exchanger (3) and an outflow channel (5) through which the fluid exits the heat exchanger (3). A stack (6) of heat exchanger plates (7) is arranged between the inflow channel (4) and the outflow channel (5) so that the heat exchanger plates (7) form plate channels (2) between the inflow channel (4) and the outflow channel (5) through which the fluid may pass. The cleaning system (1) comprises # a bypass conduit (8) arranged to establish a bypass flow of the fluid between the inflow channel (4) and the outflow channel (5) bypassing the stack (6) of heat exchanger plates (7), # a cleaning head (9) comprising a cleaning aperture (10) connected to the bypass conduit (8), wherein the cleaning aperture (10) is arranged to face the stack (6) of heat exchanger plates (7) during normal use of the cleaning head (9) in the heat exchanger (3), displacement means (11) arranged to displace the cleaning head (9) linearly in a displacement direction in the inflow channel (4) or the outflow channel (5), and pressure altering means (12) arranged to alter the pressure in the bypass conduit (8), wherein the projected area (13) of the cleaning head (9) in the displacement direction is smaller than the cross-sectional
(Continued)

Figure 1:
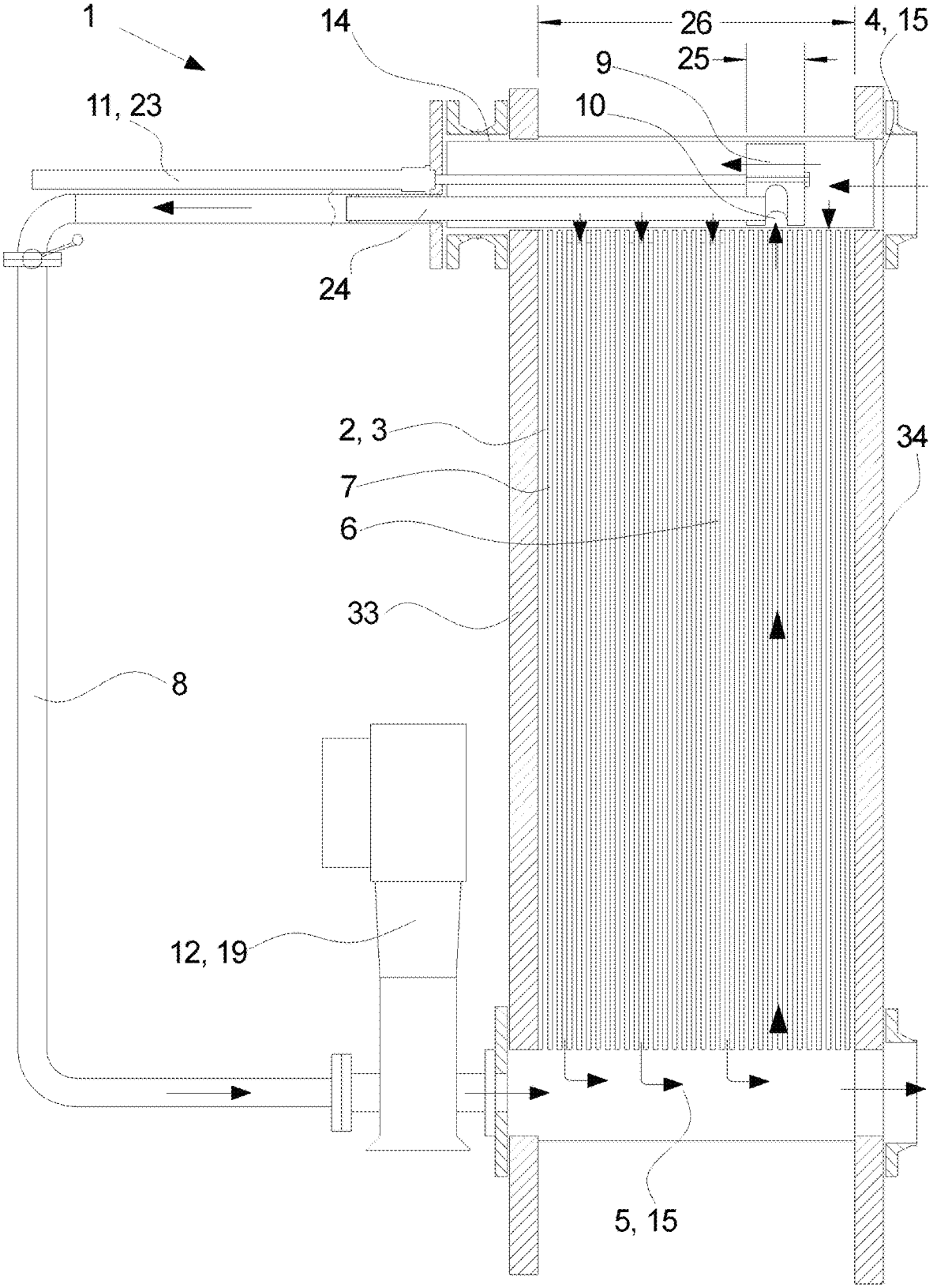

area in the displacement direction of the inflow channel (4) or the outflow channel (5) in which the cleaning head (9) is placed to allow the fluid to pass the cleaning head (9) in the inflow channel (4) or the outflow channel (5). Furthermore, a plate heat exchanger (3) and a method for cleaning the plate channels (2) in a plate heat exchanger (3) is disclosed.

20 Claims, 5 Drawing Sheets

(56) References Cited

FOREIGN PATENT DOCUMENTS

| | | | |
|---|---|---|---|
| WO | WO-2013/085332 | A | 6/2013 |
| WO | WO-2016/189184 | A1 | 12/2016 |

OTHER PUBLICATIONS

International Search Report and Written Opinion for PCT/DK2020/050115, dated Dec. 17, 2020, 9 pgs.

* cited by examiner

CLEANING SYSTEM, A PLATE HEAT EXCHANGER AND A METHOD FOR CLEANING THE PLATE CHANNELS IN A PLATE HEAT EXCHANGER

This application is a national stage of International Application No. PCT/DK2020/050115, filed on Apr. 27, 2020. The entire contents of this application is incorporated herein by reference.

FIELD OF THE INVENTION

The invention relates to a cleaning system for cleaning the plate channels in a plate heat exchanger during normal use of the plate heat exchanger, wherein the plate heat exchanger comprises an inflow channel through which a fluid enters the plate heat exchanger and an outflow channel through which the fluid exits the plate heat exchanger. The invention also relates to a method for cleaning the plate channels in a plate heat exchanger during normal use of the plate heat exchanger and a plate heat exchanger comprising a cleaning system.

BACKGROUND OF THE INVENTION

A plate heat exchanger is a type of heat exchanger that uses metal plates to transfer heat between two fluids. The plate heat exchanger (PHE) is a specialized design with two alternating chambers, usually thin in depth, separated at their largest surface by a corrugated metal plate. The plates used in a plate heat exchanger are typically obtained by one piece pressing of metal plates. Stainless steel is a commonly used metal for the plates because of its ability to withstand high temperatures, its strength, and its corrosion resistance. The plates are often sealed by rubber sealing gaskets which are placed into a grove around the edge of the plates. The plates are pressed to form troughs at right angles to the direction of flow of the fluid which runs through the channels in the plate heat exchanger. These troughs are arranged so that they interlink with the other plates which forms the plate channel with gaps of e.g. 0.1-8 mm between the plates. The plates are compressed together in a rigid frame to form an arrangement of parallel plate channels with alternating hot and cold fluids. The plates produce an extremely large surface area, which allows for the fastest possible transfer. Making each chamber thin ensures that the majority of the volume of the liquid contacts the plate, again aiding exchange. However, over time deposit forms in the plate channels—also called fouling—which will reduce the efficiency of the plate heat exchanger. It is therefore known to regularly disassemble the plate heat exchanger to remove the fouling and then reassemble it. But this is expensive and requires that the plate heat exchanger is taken out of operation for a substantial amount of time.

Thus, from the international patent application WO 2013/085332 A1 it is known to mount a washing apparatus comprising a movable washing tube plug in the inflow channel of a plate heat exchanger. The washing tube plug will concentrate the fluid flow to a few plate channels at a time, thus increasing the flow rate and thereby washing the channels. But this system requires that the plate heat exchanger is taken out of operation during the washing process.

Thus, from international patent application WO 2016/189184 A1 it is known to clean the plate channels of a plate heat exchanger used in an application for cooling gas during use by means of a movable cleaning device in the inflow channel, wherein the cleaning device is capable of releasing a instantaneous discharge of gas to form a cleaning blast through the few plate channels covered by the cleaning device. To ensure (almost) normal operation of the plate heat exchanger during cleaning, a bypass duct is formed around the inflow channel to ensure that normal flow, through the plate channels not being covered by the cleaning device, can be established on both sides of the cleaning device. However, this system is costly and difficult to install.

It is therefore an objective of the present invention to provide for a more efficient technique for cleaning the plate channels in a plate heat exchanger during normal use of the plate heat exchanger.

THE INVENTION

The invention provides for a cleaning system for cleaning the plate channels in a plate heat exchanger during normal use of the plate heat exchanger, wherein the plate heat exchanger comprises an inflow channel through which a fluid enters the plate heat exchanger and an outflow channel through which the fluid exits the plate heat exchanger. A stack of plate heat exchanger plates is arranged between the inflow channel and the outflow channel so that the plate heat exchanger plates form plate channels between the inflow channel and the outflow channel through which the fluid may pass. The cleaning system comprises

- a bypass conduit arranged to establish a bypass flow of the fluid between the inflow channel and the outflow channel bypassing the stack of heat exchanger plates,
- a cleaning head comprising a cleaning aperture connected to the bypass conduit, wherein the cleaning aperture is arranged to face the stack of heat exchanger plates during normal use of the cleaning head in the heat exchanger,
- displacement means arranged to displace the cleaning head linearly in a displacement direction in the inflow channel or the outflow channel, and
- pressure altering means arranged to alter the pressure in the bypass conduit, wherein the projected area of the cleaning head in the displacement direction is smaller than the cross-sectional area in the displacement direction of the inflow channel or the outflow channel in which the cleaning head is placed to allow the fluid to pass the cleaning head in the inflow channel or the outflow channel.

Forming the projected area of the cleaning head so that it is smaller than the cross-sectional area of the channel in which the cleaning head is placed is advantageous, in that it allows the fluid to pass the cleaning head in that channel and thereby in a simple manner ensure normal operation of the plate heat exchanger during the cleaning process. And by establishing a bypass conduit connected to the cleaning aperture ensures that the plate channels can be cleaned by means of the fluid already present in the channels thus reducing cost and the risk of contaminating the fluid.

It should be noted that the term "displacement means" should be understood as any kind of displacer suited for displacing a cleaning head linearly in an inflow channel or an outflow channel of a plate heat exchanger. I.e. the term includes any kind of hydraulic actuator, pneumatic actuator, electric actuator, chain and motor drive, spindle drive, pinon drive or other or any combination thereof.

It should be noted that the term "pressure altering means" should be understood as any kind of pressure modifier suited for altering or modifying the pressure in the bypass conduit in relation to what the pressure would be in the bypass conduit if the pressure altering means was not present to amplify the flow through the bypass conduit. Thus, the term includes any kind of pump, fluid drainer, fluid adder, valve arrangement controlling fluid communication to an area with higher or lower pressure or other or any combination thereof. It should also be noted that the pressure altering means can be arranged to alter the pressure in the bypass conduit so that the pressure at the cleaning head is increased and thereby increase the flow rate of the fluid out of the cleaning aperture or the pressure altering means can be arranged to alter the pressure in the bypass conduit so that the pressure at cleaning head is decreased and thereby reverse the flow direction through the cleaning aperture to make the cleaning head suck in fluid. Or the pressure altering means can be arranged to alternate between sucking and blowing the fluid.

In an aspect of the invention, the cleaning system further comprises a perforated tunnel arranged to guide the linear displacement of the cleaning head in the inflow channel or the outflow channel.

The channel in which the cleaning head is running can comprise edges or bumps that could catch the cleaning head or at least reduce the cleaning heads ability to form a concentrated cleaning flow through the plate channels it covers. Thus, it is advantageous to line the given inflow channel or outflow channel with a perforated tunnel to allow smooth displacement of the cleaning head while at the same time allowing free fluid flow through the perforations in the tunnel. Furthermore, the perforated tunnel may act as a sieve preventing foreign objects such as oxide scales, gasket parts or other to enter and potentially block the plate channels. The displacement of the cleaning head will then push or pull the foreign objects away from the plate stack and ensure that the foreign object will not affect operation of the heat exchanger.

In an aspect of the invention, the perforated tunnel is adapted fit the walls of the inflow channel or the outflow channel.

Making the perforated tunnel fit the walls of the inflow channel or the outflow channel in which the cleaning head is running is advantageous, in that it enables that the high speed fluid flow generated by the cleaning head is concentrated through the plate channels covered by the cleaning aperture—thus, ensuring more efficient cleaning.

In an aspect of the invention, the size of the perforations in the perforated tunnel is bigger at the outside surface of the tunnel than on the inside surface of the tunnel.

Forming the perforations bigger on the outside surface than on the inside surface of the tunnel is advantageous in that this will reduce the blocking of the in or outflow of the plate channel.

In an aspect of the invention, the perforated area on the inside surface of the perforated tunnel is between 10% and 95%, preferably between 40% and 90% and most preferred between 60% and 85%.

If the perforated area is too small, too little fluid can pass through the wall of the tunnel and the efficiency of the plate heat exchanger is reduced. However, if the perforated area is too big the structural integrity of the tunnel can be compromised, and the sieve effect of the tunnel is reduced. Thus, the present area ranges present an advantageous relationship between heat exchanger efficiency and tunnel durability.

In an aspect of the invention, the pressure altering means comprises a pump.

Using a pump to alter the pressure in the bypass conduit is advantageous, in that a pump is a simple and easily controllable way of altering the pressure.

In an aspect of the invention, the pump has a capacity of between 1 and 90 cubic meter per hour, preferably between 5 and 50 cubic meter per hour and most preferred between 10 and 35 cubic meter per hour.

If the capacity of the pump is too little the cleaning effect is reduced and/or the cleaning process takes too long. However, if the capacity of the pump is too high the pump becomes to power consuming and expensive. Thus, the present capacity ranges present an advantageous relationship between efficiency and cost.

In an aspect of the invention, the pressure altering means comprises a valve comprising mounting means for mounting the valve at an outflow opening of the plate heat exchanger and in an aspect of the invention, the bypass conduit is arranged to establish a bypass flow between the inflow channel and the outflow channel after the valve as seen in the flow direction during normal use of the plate heat exchanger.

Placing a valve at the outflow opening of the heat exchanger and connecting the bypass conduit to the outflow channel after the valve—as seen in the flow direction during normal use—enables that the pressure in the bypass conduit can be altered simply by closing the valve at least partly—thus, increasing the pressure in the outflow channel before the valve in relation to the pressure in the outflow valve after the valve and thus increasing the flow rate through the bypass conduit and thus the cleaning aperture. Hereby a power consuming pump can be avoided.

In an aspect of the invention, the displacement means comprises a linear actuator.

Displacing the cleaning head in the inflow or the outflow channel by means of a linear actuator is a simple and precise way of automating the displacement.

In an aspect of the invention, the cleaning head is connected to the bypass conduit through a telescopic pipe part.

Connecting the cleaning head to the bypass conduit through a telescopic pipe part is a space efficient and inexpensive way of ensuring that the stationary part of the bypass conduit can be connected to the moving cleaning head.

In an aspect of the invention, the pressure altering means is arranged to lower the pressure at the cleaning head to make the cleaning head suck.

Reducing the pressure at the cleaning aperture so that the cleaning head sucks is advantageous, in that this enables that the cleaning head will also suck in the cleaned off material and e.g. any foreign objects which then can be removed in the bypass conduit or elsewhere. And if the cleaning head is located in the inflow channel the sucking action of the cleaning head will also reverse the flow direction through the plate channels being cleaned, which will further increase the cleaning effect.

In an aspect of the invention, the displacement means is arranged for displacing the cleaning head in the inflow channel.

Displacing the cleaning head in the inflow channel is advantageous in that enables that the displacement of the cleaning head also can be used for displacing any foreign objects away from the plate stack. Furthermore, if the pressure altering means is arranged to make the cleaning head suck in the inflow channel any cleaned off material, dirt or other will bypass the plate channels and the risk of this material clogging the plate channels is reduced.

In an aspect of the invention, the displacement means are arranged to displace the cleaning head across the entire stack of heat exchanger plates in the heat exchanger which is advantageous in that the entire stack of heat exchanger plates hereby can be cleaned by the cleaning system.

In an aspect of the invention, the extend of the cleaning head in the displacement direction is between 50% and 99%, preferably between 60% and 97% and most preferred between 70% and 95% smaller than the width of the stack of heat exchanger plates as seen in the displacement direction.

If the extend of the cleaning head in the displacement direction is too long, the cleaning head will take too many plate channels out of operation during the cleaning process and the needed pump capacity will be too high. However, if the extend of the cleaning head is too short the cleaning process will take too long—thus increasing power consumption—and it will become difficult to make the cleaning head run stable and uniformly in the inflow or outflow channel. Thus, the present extend ranges presents an advantageous relationship between efficiency and stability.

In an aspect of the invention, the projected area of the cleaning head is between 10% and 95%, preferably between 30% and 90% and most preferred between 50% and 85% smaller than the cross-sectional area of the inflow channel or the outflow channel in which the cleaning head is placed.

If the projected area of the cleaning head is too small in relation to the cross-sectional area of the channel in which the cleaning head is running, the flow rate through the cleaning aperture and the structural integrity of the cleaning head will be reduced. However, if the projected area is too big in relation to the channel, too little fluid is able to pass the cleaning head during use and the efficiency of the plate heat exchanger is thereby reduced. Thus, the present extend ranges presents an advantageous relationship between efficiency of the cleaning system and the heat exchanger.

In an aspect of the invention, the outer shape of the cleaning head as seen in the displacement direction is substantially identical with the inner shape of the inflow channel or the outflow channel in which the cleaning head is placed.

Forming the outer contour of the cleaning head substantially identical with the inner contour of the channel in which the cleaning head is running is advantageous in that this will enable that the cleaning head is held stable in the channel.

In an aspect of the invention, the cleaning head is provided with one or more through-going openings in the displacement direction.

Reducing the projected area of the cleaning head by forming through-going openings in the head is advantageous, in that this enables free fluid flow past the cleaning head during use while at the same time enables that the head can be held stable in the channel.

In an aspect of the invention, the cleaning system comprises a first cleaning head arranged to be placed in the inflow channel and a second cleaning head arranged to be placed in the outflow channel.

Providing the cleaning system with a first cleaning head arranged in the inflow channel and a second cleaning head arranged in the outflow channel is advantageous in that the cleaning process hereby can be more efficient.

In an aspect of the invention, the position of the first cleaning head is aligned with the position of the second cleaning head in the displacement direction.

Aligning first cleaning head with the second cleaning head is advantageous in that this enables that a more or less closed cleaning circuit can be formed through the bypass conduit and through the plate channels between the cleaning heads.

In an aspect of the invention, the displacement means are arranged to maintain the position of the first cleaning head aligned with the position of the second cleaning head in the displacement direction during displacement of the first and second cleaning head.

Arranging the displacement means to aligning first cleaning head with the second cleaning head is advantageous in that this enables that a more or less closed cleaning circuit can be formed through the bypass conduit and through the plate channels between the cleaning head throughout the entire displacement of the cleaning heads.

In an aspect of the invention, the cleaning system further comprises a detergent unit arranged to add a detergent to the fluid flow in the bypass conduit.

Making the cleaning system comprises a detergent unit arranged to add a detergent to the fluid flow in the bypass conduit is advantageous in that this will increase the efficiency of the cleaning system.

It should be noted that in this context the term "detergent" includes any kind of substance capable of increasing the efficiency of the cleaning process—such as any kind of soap, solvent, acid, base or other or any combination thereof.

In an aspect of the invention, the cleaning system further comprises a heating unit arranged to heat the fluid flow in the bypass conduit.

Hearting the fluid flow in the bypass conduit e.g. even to the state of steam is advantageous in that this will increase the efficiency of the cleaning process.

In an aspect of the invention, the extend of the cleaning aperture in the displacement direction is between 60% and 99.9%, preferably between 75% and 99.8% and most preferred between 90% and 99.7% smaller than the width of the stack of heat exchanger plates as seen in the displacement direction.

If the extend of the cleaning aperture in the displacement direction is too long the cleaning head capacity will have to be raised drastically to ensure a sufficient cleaning flow. However, if the extend of the cleaning aperture is too short the cleaning process will take too long—thus increasing power consumption. Thus, the present extend ranges presents an advantageous relationship regarding efficiency.

In an aspect of the invention, the pressure altering means are arranged to alter the pressure so that the flow rate in the bypass conduit is increased between 1.1 and 10 times, preferably between 1.2 and 8 times and most preferred between 1.3 and 5 times.

If the pressure altering means are arranged to alter the flow rate too much in relation to the normal flow rate in the bypass conduit (i.e. the flow rate in the bypass conduit if no pressure altering means was present), the equipment will be too strained, and the risk of breakdown or leakage is increased. However, if the flow rate is altered too little the cleaning effect is too weak. Thus, the present pressure ranges present an advantageous relationship between durability and efficiency.

The invention further provides for a plate heat exchanger comprising a cleaning system according to any of the previously discussed cleaning systems.

Using the cleaning system according to the present invention in a plate heat exchanger is advantageous in that such a plate heat exchanger would be efficient in relation to exchanging heat, inexpensive and space efficient.

The invention also provides for a method for cleaning the plate channels in a plate heat exchanger during normal use of the heat exchanger, wherein the heat exchanger comprises an inflow channel through which a fluid enters the heat exchanger and an outflow channel through which the fluid exits the heat exchanger. A stack of heat exchanger plates is arranged between the inflow channel and the outflow channel so that the heat exchanger plates form plate channels between the inflow channel and the outflow channel through which the fluid may pass. The method comprises the steps of:

- placing a cleaning head in the inflow channel or the outflow channel and directing a cleaning aperture of the cleaning head in the direction of the stack of heat exchanger plates,
- forming a bypass conduit between the inflow channel and the outflow channel bypassing the stack of heat exchanger plates,
- connecting the cleaning aperture to the bypass conduit,
- creating a cleaning flow through the cleaning aperture of the cleaning head by altering the pressure in the bypass conduit, and
- displacing the cleaning head along the stack of heat exchanger plates, while allowing the fluid to pass by the cleaning head in the inflow channel or the outflow channel.

Forming the bypass conduit and allowing the fluid to pass by the cleaning head in the channel in which it is running is advantageous, in that the plate channels can be cleaned by means of the existing fluid and that the cleaning head will substantially not influence normal operation of the plate heat exchange.

In an aspect of the invention, the method is performed on a plate heat exchanger according to any of the previously discussed plate heat exchangers.

Hereby is achieved an advantageous embodiment of the invention.

FIGURES

Figure 2:
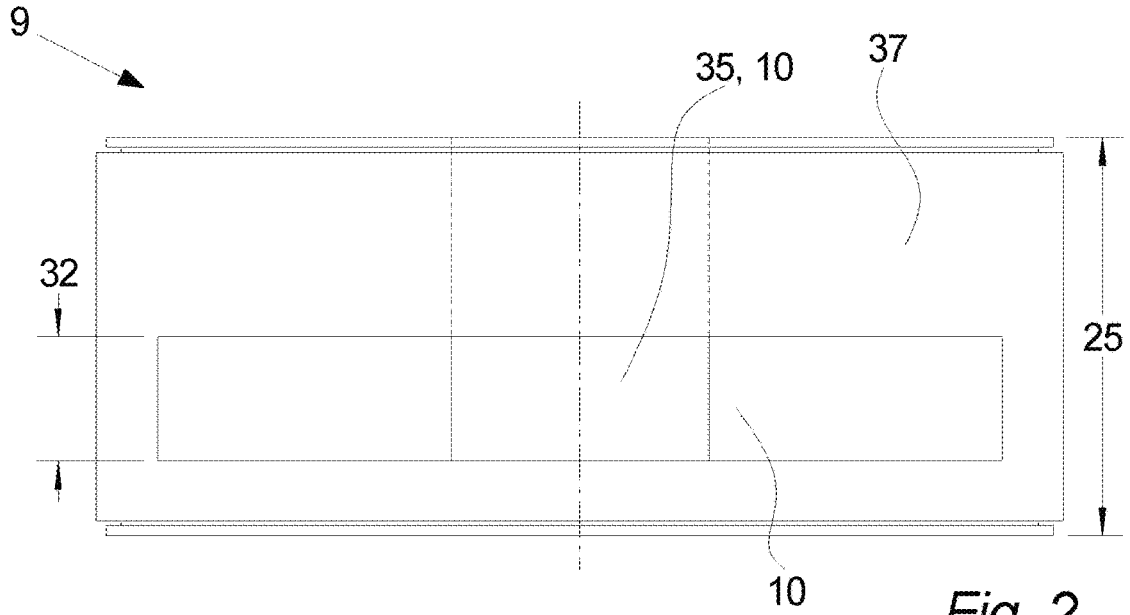
Figure 3:
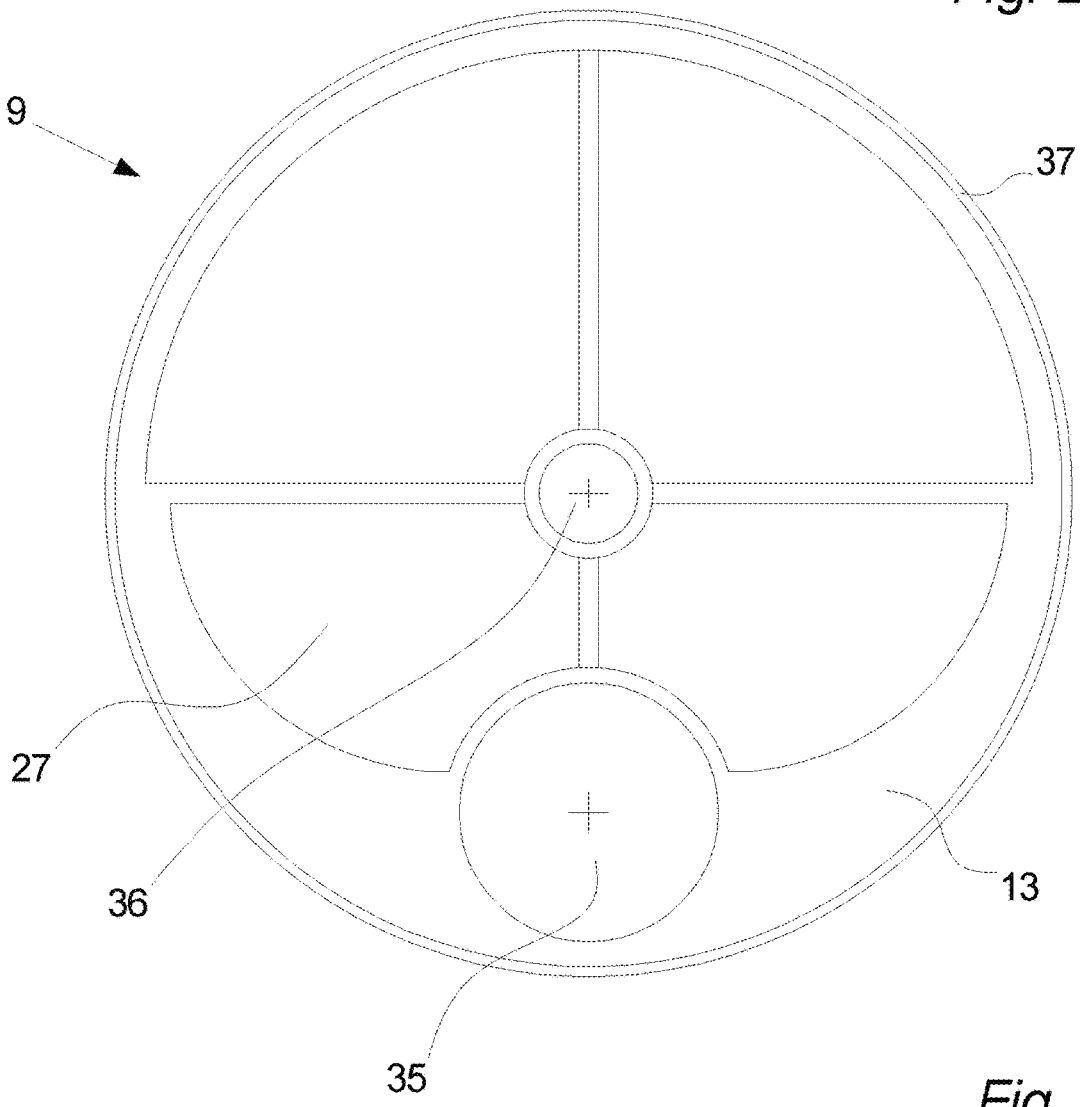
Figure 5:
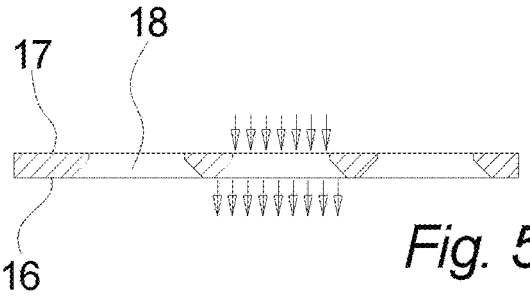
Figure 4:
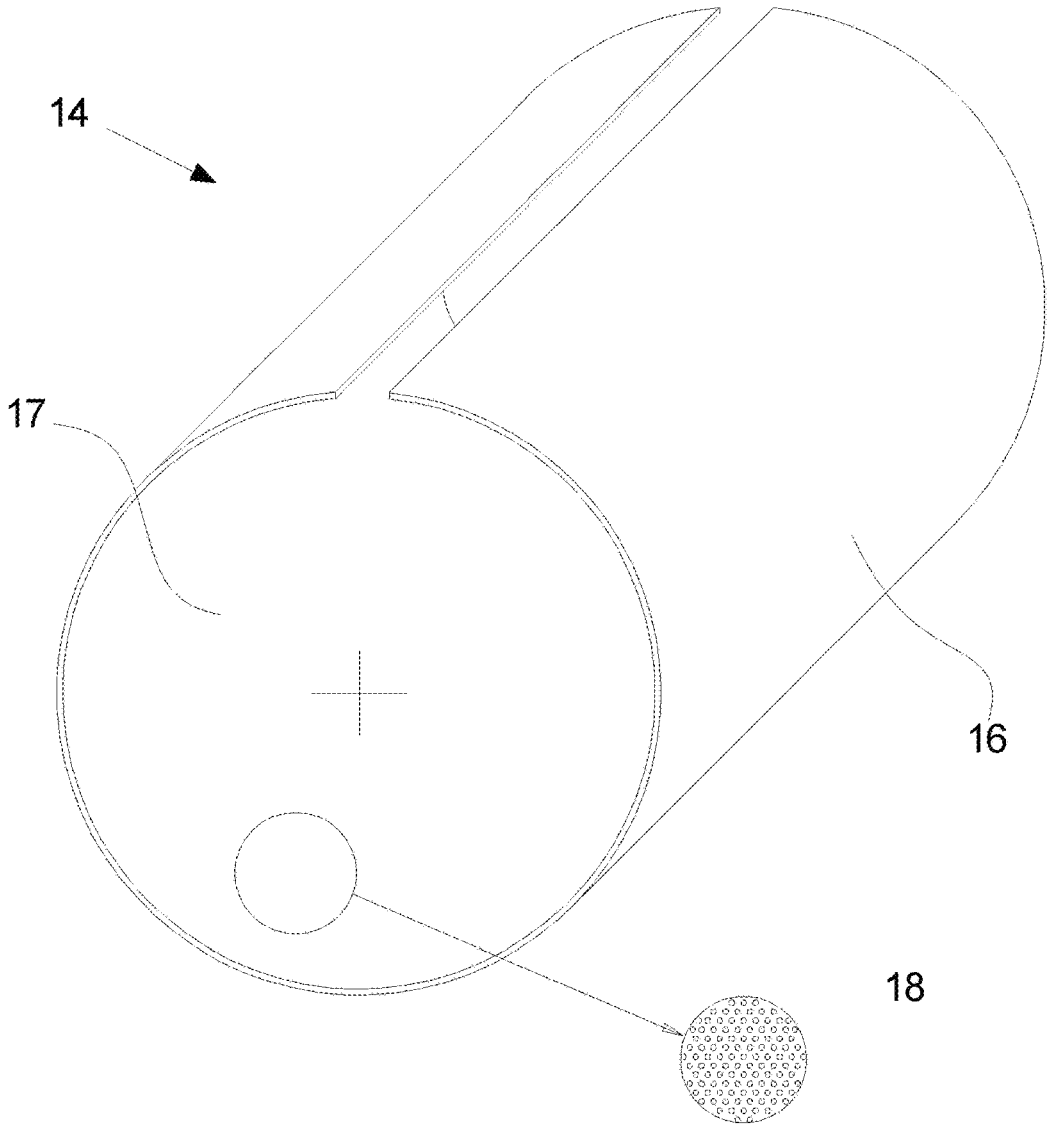
Figure 6:
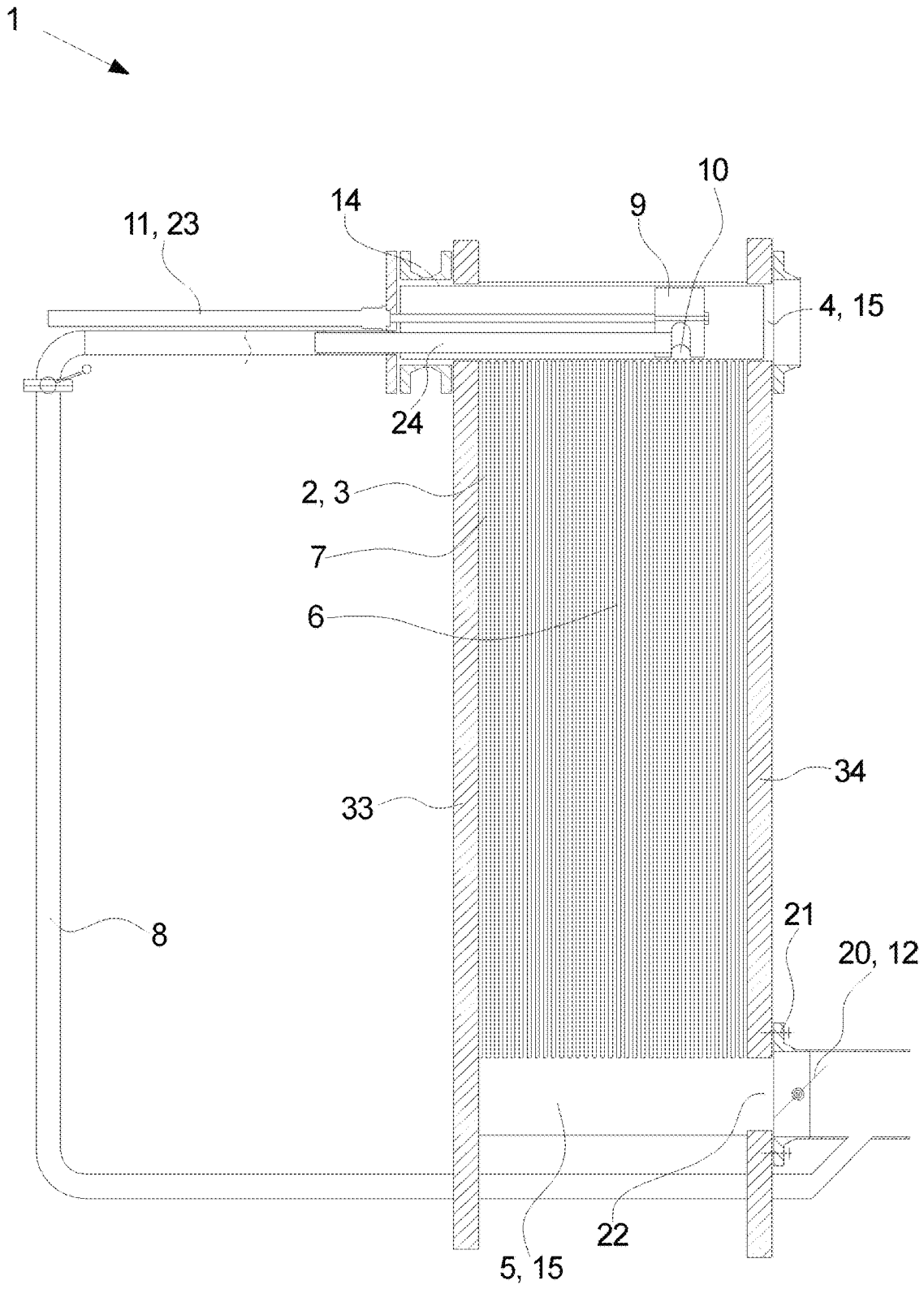
Figure 7:
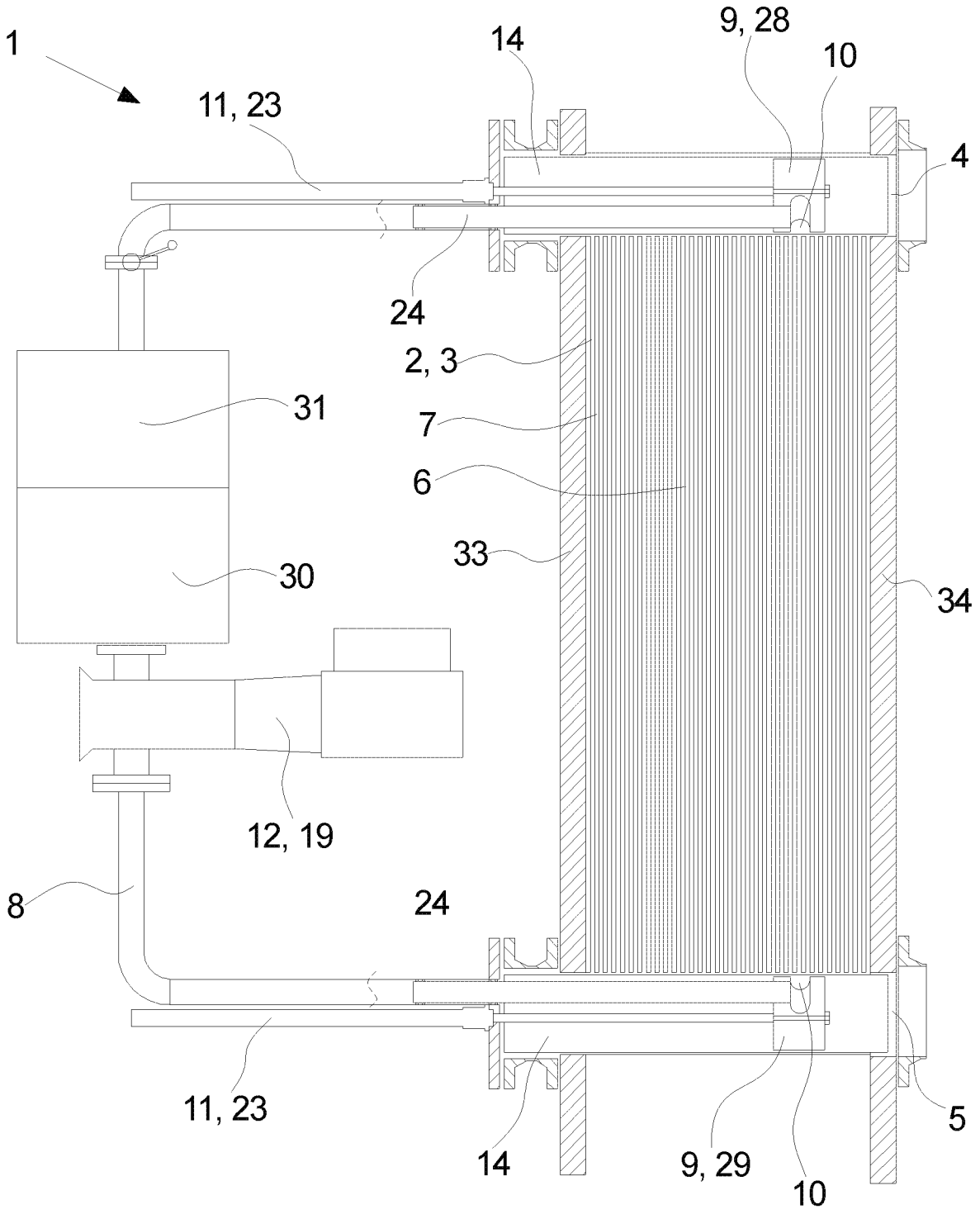

The invention will be described in the following with reference to the figures in which FIG. 1. illustrates a part cross section through a plate heat exchanger comprising a cleaning system, as seen from the side, FIG. 2 illustrates a cleaning head, as seen from the bottom, FIG. 3 illustrates a cleaning head, as seen from the front, FIG. 4 illustrates a perforated tunnel, as seen in perspective, FIG. 5 illustrates a cut out of a perforated tunnel, as seen from the side, FIG. 6 illustrates a cleaning system where the pressure altering means comprises a valve, as seen from the side, and FIG. 7 illustrates a cleaning system comprising a detergent unit and a heating unit, as seen from the side

DETAILED DESCRIPTION

FIG. 1 illustrates a part cross section through a plate heat exchanger 3 comprising a cleaning system 1, as seen from the side.

In this embodiment the plate heat exchanger 3 is a conventional large commercial plate heat exchanger 3 comprising a plurality of corrugated stainless steel heat exchanger plates 7 spaced by rubber sealing gaskets (not shown) to form a stack 6 of heat exchanger plates 7 being compressed between a first end plate 33 and a second end plate 34 being held together by traverse tightening bolts (not shown) at the corners and/or along the sides of the end plates 33, 34. However, in another embodiment the stack 6 of heat exchanger plates 7 could instead be brazed, welded and/or semi-welded. The heat exchanger plates 7 typically forms two plate channels 2 through which two separate fluids may flow to exchange heat. Often one of these plate channels 2 are part of a closed fluid circuit arranged to cool or heat another fluid forming part of an open circuit flowing through the other plate channels 2. The fluid in the closed fluid circuit will not get dirty or contaminated by exposure to the surrounding and since it is running in a closed circuit, additives can be added to avoid decomposition or deterioration of the fluid and deposit buildup in the plate channels. However, the fluid running through the open circuit will constantly bring dirt, foreign objects and/or other into the plate channels 2, and since the circuit is open, the fluid can typically not be treated to avoid forming deposit in the plate channels 2. Thus, the cleaning system 1 according to the present invention can be used for cleaning the plate channels 2 in the open fluid circuit but in certain case it can also be used for cleaning the plate channels 2 in a closed fluid circuit.

A typical plate heat exchanger 3 comprises an inflow channel 4 and an outflow channel 5 for each of these fluid flows and in FIGS. 1, 6 and 7 a cross section is made through the inflow channel 4 and the outflow channel 5 of an open fluid circuit. Thus, in this embodiment the heat exchanger 3 only comprises one cleaning system 1 arranged in one of the inflow channels 4 but in another embodiment the cleaning system 1—or at least parts of a cleaning system 1—could be arranged in the other inflow channel (which is not shown in FIGS. 1, 6 and 7), it could be arranged in one of the outflow channels 5, it could be arranged in both inflow channels 4 of the heat exchanger 3, in both outflow channels 5 of the heat exchanger 3 or in all inflow channels 4 and outflow channels 5 of the heat exchanger 3.

In this embodiment the cleaning system 1 comprises a single cleaning head 9 comprising a single cleaning aperture 10 facing downwards towards the plate stack 6.

However, in another embodiment the system 1 could comprise more cleaning heads 9 in the same inflow and/or outflow channel 4, 5 and/or each head 9 could comprise more than one cleaning aperture 10. In this embodiment the projected area 13 of the cleaning head 9—as seen in the displacement direction of the cleaning head (i.e. as seen from one end of the longitudinal inflow channel 4)—is smaller than the cross-sectional area of the inflow channel 4—as also seen in the displacement direction—to allow fluid to pass the cleaning head 9 in the inflow channel 4. Thus, when the cleaning system 1 is in use and moving along the plate stack 6, fluid may flow normally through the plate channels 2 in front of the cleaning head 9 and fluid may flow past the cleaning head 9 and through the plate channels 2 on the other side of the cleaning head 9 as normal. Thus, in this embodiment the plate heat exchanger 3 will maintain almost its normal capacity during the cleaning process because only the few plate channels 2 covered by the cleaning head 9 is taken out of operation during the cleaning process. The same principle obviously applies if the cleaning head 9 instead was placed in the outflow channel 5. The design of the cleaning head 9 will be discussed in more details in relation to FIGS. 2 and 3.

In this embodiment the cleaning head 9 is displaced back and forth in the inflow channel 4 by displacement means 11 in the form of a hydraulic linear actuator 23. However, in another embodiment the displacement means 11 could be enabled in numerous other ways. When the cleaning process is initiated the displacement means 11 will in this embodiment displace the cleaning head 9 at a steady pace across the entire plate stack 6 and back. In this embodiment the cleaning process is manually initiated but in another embodiment the cleaning system 1 could be arranged to operated constantly while the plate heat exchanger 3 is in operation, it could comprise a control unit (not shown) arranged to start the cleaning process at regular intervals, it could be arranged to start the cleaning process a specific times—e.g. corresponding to times when the heat exchanger is not operating at maximum capacity—or other or any combination thereof.

In another embodiment the displacement means 11 could be arranged to move the cleaning head 9 in steps—i.e. the displacement means 11 could move the cleaning head 9 a distance corresponding to the width of the cleaning aperture 10 and then pause before moving the cleaning head 9 this distance again.

In this embodiment a bypass conduit 8 forms fluid communication between the outflow channel 5 and the inflow channel 4 in which the bypass conduit 8 is connected to the cleaning head 9 through a telescopic pipe part 24 enabling that the bypass conduit 8 stays connected to the cleaning head 9 even when the cleaning head 9 is displaced back and forth. However, in another embodiment the connection between the bypass conduit 8 and the cleaning head 9 could be formed by a flexible tube part, a spiral hose, a flexible bypass conduit or other.

To alter the flow through the bypass conduit 8, the bypass conduit 8 is in this embodiment provided with pressure altering means 12 in the form of a pump 19. However, in another embodiment the pressure altering means 12 could be formed in numerous other ways including the way discussed in relation to FIG. 4. In this embodiment the pressure altering means 12 are arranged to generate a flow from the cleaning head 9 in the inflow channel 4 towards the outflow channel 5 so that the cleaning head 9 will suck fluid up through the plate channels 2 covered by the cleaning aperture 10, so that the cleaning flow through the plate channels 2 is reversed in relation to the normal flow direction during normal use of the plate heat exchanger 3. However, in another embodiment the pressure altering means 12 could be arranged to generate a flow from the outflow channel 5 towards the cleaning head 9 in the inflow channel 4 so that the cleaning head 9 will flush towards the outflow channel 5 or the pressure altering means 12 could be arranged to alternate the flow direction.

In this embodiment the pressure altering means 12 are arranged to alter the pressure in the bypass conduit 8 so that the flow rate through the bypass conduit 8 is increased around three times. In this embodiment the size of the cleaning aperture 10 is approximately the same as the cross sectional area of the bypass conduit 8 so that the plate channels 2 covered by the cleaning aperture 10 will experience a cleaning flow rate approximately three times the normal flow rate during normal use. However, in another embodiment the pressure altering means 12 could be arranged to generate a higher flow rate or a lower flow rate e.g. depending on the plate heat exchanger type, the fluid running in the plate channels 2, the frequency of cleaning and other.

To produce the three times higher flow rate, the pump 19 has in this embodiment a capacity of around 25 cubic meter per hour but in another embodiment the capacity of the pump 19 could be bigger or smaller e.g. dependent on the specific desired flow rate, the plate heat exchanger type, the size of the cleaning aperture and the bypass conduit 8 and other.

In this embodiment the inflow channel 4 is also provided with a perforated tunnel 14 extending the entire travel length of the cleaning head 9 in the inflow channel 4. Some plate heat exchangers 3 are formed with sharp plate joints and other that may catch the cleaning head 9 during its travels. The perforated tunnel 14 is formed to fit the cross sectional contour of the inflow channel 4 and will thus guide the cleaning head 9 in the inflow channel 4 and function as a sieve to ensure that larger foreign objects will not clog the plate channels 2. Obviously if a cleaning head 9 was also or instead located in the outflow channel 5, a perforated tunnel 14 could also be placed in the outflow channel 5. The design of the perforated tunnel 14 will be discussed in more details in relation to FIGS. 4 and 5.

Normal use of the cleaning system 1 for cleaning the plate channels 2 in a plate heat exchanger 3 during normal use of the heat exchanger will in this embodiment involve placing the cleaning head 9 in the inflow channel 4 so that the cleaning aperture 10 is directed in the direction of the stack 6 of heat exchanger plates 7 and establish the bypass conduit 8 between the cleaning aperture 10 of the cleaning head 9 in the inflow channel 4 and the outflow channel 5 to form a bypass conduit 8 bypassing the stack 6 of heat exchanger plates 7. The pressure altering means 12 arranged in the bypass conduit will then create a cleaning flow through the cleaning aperture 10 by altering the pressure in the bypass conduit 8 to create at cleaning flow in through the cleaning aperture and out into the outflow channel 5, while the displacing means 11 displaces the cleaning head 9 along the stack 6 of heat exchanger plates 7 and allows fluid to pass by the cleaning head 9 in the inflow channel 4. Obviously, the same method applies if the cleaning head 9 also or instead was located in the outflow channel 5.

FIG. 2 illustrates a cleaning head 9, as seen from the bottom and FIG. 3 illustrates the cleaning head 9, as seen from the front.

In this embodiment the projected area 13 of the cleaning head 9 is smaller than the cross-sectional area of the inflow channel 4, in that the cleaning head 9 in this embodiment comprises four through-going openings 27 through which fluid may flow though the cleaning head 9 in the displacement direction. However, in another embodiment the cleaning head 9 could comprises another number of through-going openings 27—such as one, two, six, eight or more or the cleaning head 9 could also or instead be formed as part cylinder, a crescent or other. However, it is advantageous that most of the periphery of the cleaning head 9 corresponds to the inside contour of the channel 4, 5 in which is placed, to ensure a tight fit so that the cleaning aperture 10 is maintained against the plate stack 6 at all times. In this embodiment the cleaning head 9 has a circular outer shape to fit in a circular channel 4, 5 and/or perforated tunnel 14, however if the channel 4, 5 and/or perforated tunnel 14 had another shape—such as square, oval, rectangular or other—the cleaning head 9 would also be formed in this shape to fit the channel 4, 5 and/or perforated tunnel 14.

In this embodiment, the projected area 13 of the cleaning head 9 is around 75% smaller than the cross-sectional area of the inflow channel 4 to ensure sufficient free flow of fluid through the cleaning head 9 when it is displaced along the stack 6 of heat exchanger plates 7. Thus, in this embodiment the cleaning head 9 will only reduce the passable area in the channel 4, 5 by 25%.

In this embodiment, the extend 25 of the cleaning head 9 in the displacement direction is around 85% smaller than the width 26 of the stack 6 of heat exchanger plates 7 (see e.g. FIG. 1) to ensure that the cleaning head 9 is wide enough to prevent it from wedging and jamming during displacement.

In this embodiment, the extend 32 of the cleaning aperture 10 in the displacement direction is around 96% smaller than the width 26 of the stack 6 of heat exchanger plates 7 to ensure that sufficient flow rate can be generated through the plate channels 2 covered by the cleaning aperture 10.

In this embodiment the cleaning head comprises an inner cleaning duct 35 leading the fluid from the face of the cleaning head—at which the bypass conduit 8 is connected—to the cleaning aperture 10. In this embodiment the cross-sectional area of this cleaning duct 35 is approximately equal to the cross-sectional area of the bypass conduit 8. In this embodiment the cleaning aperture 10 is wider in the direction perpendicular to the displacement direction than the cleaning duct 35 to ensure that the cleaning flow is spread to the sides of the plate stack 6. However, in another embodiment the cleaning aperture 10 could be smaller e.g. if the cleaning system 1 comprised pendulum means (not shown) arranged to rotate the cleaning head 10 e.g. 30 degrees from side to side to move a more concentrated jet flow out of the cleaning aperture 10 across the entire width of a (few) plate channels 2. Or in another embodiment the cleaning aperture 10 could be even wider in the direction perpendicular to the displacement direction to ensure that all corners of the plate channels 2 are reached.

In this embodiment cleaning head 9 is provided with connection means 36 in the form of a single center hole by means of which the displacement means 11 can be connected to the cleaning head 10. The connection means 36 is in this embodiment arranged in the center of the cleaning head 9 to reduce the risk of wedging or jamming when the head 9 is moved by the displacement means 11 but in another embodiment the connection means 36 could be arranged off-center e.g. if the cleaning head 9 comprised more than one connection means 36.

In this embodiment the cleaning head 9 is provided with an outer mantle 37 formed in a plastic material to make the cleaning head 9 run smoother and make less noise when the cleaning head 9 is moved back and forth in the channel 4, 5, while at the same time ensuring a tight fit in the channel 4, 5 or in the perforated tunnel 14. However, in another embodiment the mantle 37 would not be present, it would be made in another material such as ceramic, a composite material, bronze or another metal or other or any combination thereof.

FIG. 4 illustrates a perforated tunnel 14, as seen in perspective and FIG. 5 illustrates a cut out of a perforated tunnel 14, as seen from the side.

In this embodiment the perforated tunnel 14 is cylindrical to fit a cylindrical channel 4, 5, however if the channel 4, 5 had another shape—such as square, oval, rectangular or other—the perforated tunnel 14 would also be formed in this shape to fit the channel 4, 5.

In this embodiment the size of the perforations 18 in the perforated tunnel 14 is bigger at the outside surface 16 of the tunnel 14 than on the inside surface 17 to reduce the risk of clogging and all the perforations 18 are substantially identical. However, in another embodiment the perforations 18 could have a constant size through the tunnel material and/or at least some of the perforations 18 could have different sizes.

In this embodiment the perforated area on the inside surface 17 of the perforated tunnel 14 is around 50% but in another embodiment a larger area could be perforated to ensure better or more fluid flow through the perforated tunnel 14 or a smaller area could be perforated to ensure a stiffer perforated tunnel 14.

FIG. 6 illustrates a cleaning system 1 where the pressure altering means 12 comprises a valve 20, as seen from the side.

In this embodiment the pressure altering means 12 comprise a valve 20—in this embodiment in the form of a butterfly valve—connected to the outflow opening 22 of the plate heat exchanger 3 by means of mounting means 21 and in this embodiment the bypass conduit 8 is connected to the outflow channel 5 after the valve 20 as seen in the flow direction during normal use of the plate heat exchanger 3. Thus, during normal operation of the plate heat exchanger 3 the valve 20 is fully open. Once the cleaning system 1 is engaged, the valve 20 will shut partly as disclosed in FIG. 6 to restrict flow through the valve 20. As a consequence, the pressure in the inflow channel 4, in the plate channels 2 and the outflow channel 5 under the plate stack 6 will rise in relation to the pressure where the bypass conduit 8 flow into the outflow channel 5 on the other side of the valve 20, whereby the pressure in the bypass conduit 8 is reduced in accordance with how much the valve 20 is closed. The cleaning head 9 will thereby start sucking in fluid at a relatively high flow rate and thus clean the plate channels 2 covered by the cleaning aperture 10. Thus, in this embodiment the pressure altering means 12 can be formed without the use of a pump.

FIG. 7 illustrates a cleaning system 1 comprising a detergent unit 30 and a heating unit 31, as seen from the side.

In this embodiment the cleaning system 1 comprises a first cleaning head 9, 28 running in the inflow channel 4 and a second cleaning head 9, 29 running in the outflow channel 5. The first cleaning head 9, 28 and the second cleaning head 9, 29 are maintained aligned by the displacement means 11 so that the cleaning heads 9, 28, 29, the plate channels 2 covered by the cleaning apertures 10 of the cleaning heads 9, 28, 29 and the bypass conduit 8 form an (almost) closed circuit. Thus, in this embodiment the cleaning system 1 also comprises a detergent unit 30 arranged to add a detergent to the fluid flow in said bypass conduit 8. In this embodiment the detergent is a soap-based detergent but in another embodiment any kind of substance capable of increasing the efficiency of the cleaning process could be added by the detergent unit 30. In this embodiment the cleaning system 1 is arranged to first clean the plate channels 2 covered by the cleaning apertures 10 of the cleaning heads 9, 28, 29 by adding the detergent and subsequently flush these plate channels 2 with cleaning fluid before the cleaning heads 9, 28, 29 are moved to a new location to reduce the risk of the detergent mixing with the fluid running through the heat exchanger 3. In another embodiment it could be accepted that some detergent is added to the fluid and the flushing cycle is omitted.

In this embodiment the cleaning system 1 also comprises a heating unit 31 arranged to heat the fluid flow in the bypass conduit 8, thus enabling that the fluid used in the cleaning process can be hotter that the fluid normally flowing through the plate channels 2. In this embodiment the heating unit 31 is arranged to raise the temperature of the fluid by 50 degrees Celsius but in another embodiment the heating unit 31 could be arranged to heat the fluid less—such as by 40 degrees Celsius, 30 degrees Celsius, 20 degrees Celsius or even less—or the heating unit 31 could be arranged to heat the fluid more—such as by 60 degrees Celsius, 70 degrees Celsius, 80 degrees Celsius or even more—e.g. to turn the fluid into steam to dissolve fat, without using detergent, or to accelerate chemical reaction and increase the efficiency of the cleaning system 1.

In this embodiment the detergent unit 30 and the heating unit 31 are show in relation to a cleaning system 1 comprising both a first cleaning head 9, 28 running in the inflow channel 4 and a second cleaning head 9, 29 running in the outflow channel 5. However, in another embodiment the detergent unit 30 and/or the heating unit 31 could be used in relation to a cleaning system 1 comprising only a single cleaning head 9 running in the inflow channel 4 or the outflow channel 5.

The invention has been exemplified above with reference to specific examples of cleaning systems 1, plate heat exchangers 3, pressure altering means 12 and other. However, it should be understood that the invention is not limited to the particular examples described above but may be designed and altered in a multitude of varieties within the scope of the invention as specified in the claims.

LIST

1. Cleaning system
2. Plate channel
3. Plate heat exchanger
4. Inflow channel
5. Outflow channel
6. Stack of heat exchanger plates
7. Heat exchanger plate
8. Bypass conduit
9. Cleaning head
10. Cleaning aperture
11. Displacement means
12. Pressure altering means
13. Projected area of cleaning head
14. Perforated tunnel
15. Walls of inflow channel or outflow channel
16. Outside surface of tunnel
17. Inside surface of tunnel
18. Perforation
19. Pump
20. Valve
21. Mounting means
22. Outflow opening
23. Linear actuator
24. Telescopic pipe part
25. Extend of cleaning head in displacement direction
26. Width of stack of heat exchanger plates in displacement direction
27. Through-going opening
28. First cleaning head
29. Second cleaning head
30. Detergent unit
31. Heating unit
32. Extend of cleaning aperture in displacement direction
33. First end plate
34. Second end plate
35. Cleaning duct
36. Connection means
37. Mantle

The invention claimed is:

1. A cleaning system for cleaning the plate channels in a plate heat exchanger during normal use of said heat exchanger, wherein said heat exchanger comprises an inflow channel through which a fluid enters said heat exchanger and an outflow channel through which said fluid exits said heat exchanger, wherein a stack of heat exchanger plates is arranged between said inflow channel and said outflow channel so that said heat exchanger plates form plate channels between said inflow channel and said outflow channel through which said fluid may pass, said cleaning system comprising a bypass conduit arranged to establish a bypass flow of said fluid between said inflow channel and said outflow channel bypassing said stack of heat exchanger plates, a cleaning head comprising a cleaning aperture connected to said bypass conduit, wherein said cleaning aperture is arranged to face said stack of heat exchanger plates during normal use of said cleaning head in said heat exchanger, a displacer arranged to displace said cleaning head linearly in a displacement direction in said inflow channel or said outflow channel, and a pressure modifier arranged to alter the pressure in said bypass conduit, wherein a projected area of said cleaning head in said displacement direction is smaller than the cross-sectional area in said displacement direction of said inflow channel or said outflow channel in which said cleaning head is placed to allow said fluid to pass said cleaning head in said inflow channel or said outflow channel.

2. The cleaning system according to claim 1, wherein said cleaning system further comprises a perforated tunnel arranged to guide said linear displacement of said cleaning head in said inflow channel or said outflow channel.

3. The cleaning system according to claim 2, wherein said perforated tunnel is adapted fit the walls of said inflow channel or said outflow channel.

4. The cleaning system according to claim 2, wherein the size of said perforations in said perforated tunnel is bigger at the outside surface of said tunnel than on the inside surface of said tunnel.

5. The cleaning system according to claim 1, wherein said pressure modifier comprises a valve comprising a mounter for mounting said valve at an outflow opening of said plate heat exchanger.

6. The cleaning system according to claim 5, wherein said bypass conduit is arranged to establish a bypass flow between said inflow channel and said outflow channel after said valve as seen in the flow direction during normal use of said plate heat exchanger.

7. The cleaning system according to claim 1, wherein said cleaning head is connected to said bypass conduit through a telescopic pipe part.

8. The cleaning system according to claim 1, wherein said pressure modifier is arranged to lower the pressure at said cleaning head to make said cleaning head suck.

9. The cleaning system according to claim 1, wherein said displacer is arranged to displace said cleaning head across the entire stack of heat exchanger plates in said heat exchanger.

10. The cleaning system according to claim 1, wherein the extend of said cleaning head in said displacement direction is between 50% and 99% smaller than the width of said stack of heat exchanger plates as seen in said displacement direction.

11. The cleaning system according to claim 1, wherein said projected area of said cleaning head is between 10% and 95% smaller than the cross-sectional area of said inflow channel or said outflow channel in which said cleaning head is placed.

12. The cleaning system according to claim 1, wherein the outer shape of said cleaning head as seen in said displacement direction is substantially identical with the inner shape of said inflow channel or said outflow channel in which said cleaning head is placed.

13. The cleaning system according to claim 1, wherein said cleaning head is provided with one or more through-going openings in said displacement direction.

14. The cleaning system according to claim 1, wherein said cleaning system comprises a first cleaning head arranged to be placed in said inflow channel and a second cleaning head arranged to be placed in said outflow channel.

15. The cleaning system according to claim 14, wherein the position of said first cleaning head is aligned with the position of said second cleaning head in said displacement direction.

16. The cleaning system according to claim 14, wherein said displacer are arranged to maintain the position of said first cleaning head aligned with the position of said second cleaning head in said displacement direction during displacement of said first and second cleaning head.

17. The cleaning system according to claim 1, wherein the extend of said cleaning aperture in said displacement direction is between 60% and 99.9% smaller than the width of said stack of heat exchanger plates as seen in said displacement direction.

18. The cleaning system according to claim 1, wherein said pressure modifier is arranged to alter said pressure so that the flow rate in said bypass conduit is increased between 1.1 and 10 times.

19. A plate heat exchanger comprising a cleaning system according to claim 1.

20. A method for cleaning the plate channels in a plate heat exchanger during normal use of said heat exchanger, wherein said heat exchanger comprises an inflow channel through which a fluid enters said heat exchanger and an outflow channel through which said fluid exits said heat exchanger, wherein a stack of heat exchanger plates is arranged between said inflow channel and said outflow channel so that said heat exchanger plates form plate channels between said inflow channel and said outflow channel through which said fluid may pass, said method comprising the steps of:

placing a cleaning head in said inflow channel or said outflow channel and directing a cleaning aperture of said cleaning head in the direction of said stack of heat exchanger plates, forming a bypass conduit between said inflow channel and said outflow channel bypassing said stack of heat exchanger plates, connecting said cleaning aperture to said bypass conduit, creating a cleaning flow through said cleaning aperture of said cleaning head by altering the pressure in said bypass conduit, and displacing said cleaning head along said stack of heat exchanger plates, while allowing said fluid to pass by said cleaning head in said inflow channel or said outflow channel.

* * * * *